US005540604A

United States Patent [19]

Dayton

[11] Patent Number: 5,540,604

[45] Date of Patent: Jul. 30, 1996

[54] AQUATIC VEHICLE WITH ARTICULATED STEERING

[75] Inventor: Robert L. Dayton, Lake Barrington, Ill.

[73] Assignee: Water Sports International, Ltd., Barrington, Ill.

[21] Appl. No.: 263,833

[22] Filed: Jun. 22, 1994

[51] Int. Cl.[6] ..... B63H 16/20

[52] U.S. Cl. ..... 440/27; 114/283; 114/61

[58] Field of Search ..... 440/26–30; 114/61, 114/283

[56] References Cited

U.S. PATENT DOCUMENTS

| | | | |
|---|---|---|---|
| 1,126,037 | 1/1915 | Lehotsky . | |
| 1,364,961 | 1/1921 | Thompson . | |
| 1,744,075 | 1/1930 | Hantjopoulos . | |
| 1,831,229 | 11/1931 | Clark . | |
| 3,083,382 | 4/1963 | Havens et al. . | |
| 3,970,025 | 7/1976 | Sovia et al. | 114/61 |
| 4,459,116 | 7/1984 | Moore | 440/31 |
| 4,968,274 | 11/1990 | Gregory | 440/27 |
| 5,011,441 | 4/1991 | Foley et al. | 440/30 |
| 5,088,944 | 2/1992 | Kats | 440/26 |
| 5,301,623 | 4/1994 | McMillen | 114/61 |

*Primary Examiner*—Jesus D. Sotelo
*Attorney, Agent, or Firm*—Michael B. McMurry

[57] ABSTRACT

The steering of a human powered pontoon aquatic vehicle is improved by arranging the pontoons in three articulated sections. The forward and aft pontoon sections are rotated in reciprocal directions with the forward sections being rotated in the direction of the desired turn. The vehicle includes a support frame attached to the forward and aft pontoon sections upon which a seat is mounted. A central frame member attached to the central pontoon is shifted laterally with respect to the support frame in order to rotated the forward and aft pontoon sections. The forward and aft pontoon sections are connected to the central pontoon section by interlocking hinges which permits convenient disassembly of the vehicle for transportation.

16 Claims, 3 Drawing Sheets

AQUATIC VEHICLE WITH ARTICULATED STEERING

TECHNICAL FIELD

The invention relates to the field of aquatic vehicles and in particular to human powered pontoon water vehicles.

BACKGROUND OF THE INVENTION

Human powered aquatic vehicles, also known as water bikes, are becoming very popular for recreational use as well as exercise equipment. However, due to their size, low speed and fractional horse power, maneuverability is a problem. Normally, rudders are used to control and turn these types of water craft, but rudders can be ineffective at the relatively slow speeds that these types of craft operate.

In addition, pontoon boats tend to be awkward to transport due to the length of the pontoons. This is a particular disadvantage for the small water bike type craft where it is often desired to transport them by automobile.

SUMMARY OF THE INVENTION

It is therefore an object of the invention to provide a human powered aquatic vehicle which has an improved steering system and is readily transportable.

It is a further object of the invention to provide an aquatic vehicle which has two articulated pontoons which is steered by turning a forward section of each pontoon in the desired direction and turning an aft section of each pontoon in the reciprocal direction.

An additional object of the invention is to provide an aquatic vehicle having a pair of pontoons, each of which includes a forward and an aft section, hinged to rotate with respect to a center section that can be steered by rotating the forward sections in the desired direction of a turn and by rotating the aft sections in the opposite direction. The vehicle includes a support frame attached to the forward and aft pontoon sections upon which a seat is mounted. A central frame member is attached to the central pontoon sections. Steering is accomplished by laterally shifting the central frame member with respect to the support frame which has the effect of turning the forward pontoon sections in the desired direction and turning the aft pontoon sections in the reciprocal direction. The translation of the central frame member with respect to the support frame is effected by a steering mechanism that includes a steering lever connected to a steering rod, which in turn, is connected to one end of a bell crank that is rotationally secured to the support frame. The other end of the bell crank is attached to the central frame member so that when the steering lever is move forward or back, the central frame member will move laterally with respect to the support frame.

It is yet another object of the invention to provide an aquatic vehicle having floatation pontoons that can easily be disassembled for transport. The pontoons are divided into forward, central and aft sections where the pontoons are connected by an interlocking hinge or socket arrangement and where the vehicle's support frame is mounted on the forward and aft pontoon sections and the buoyancy of the central section selves to keep the forward and aft sections connected to the central section.

Another object of the invention is to provide a human powered aquatic vehicle having a pair of floatation pontoons where propulsion is provided by a propeller connected by a transmission to a pair of pedals and where the pedals and the transmission are mounted forward of a seat secured between the two pontoons. The transmission can be mounted such that the transmission and the propeller will rotate upwardly and to the rear in the event that they should strike an object in the water.

DETAILED DESCRIPTION OF THE INVENTION

Figures 1, 2:
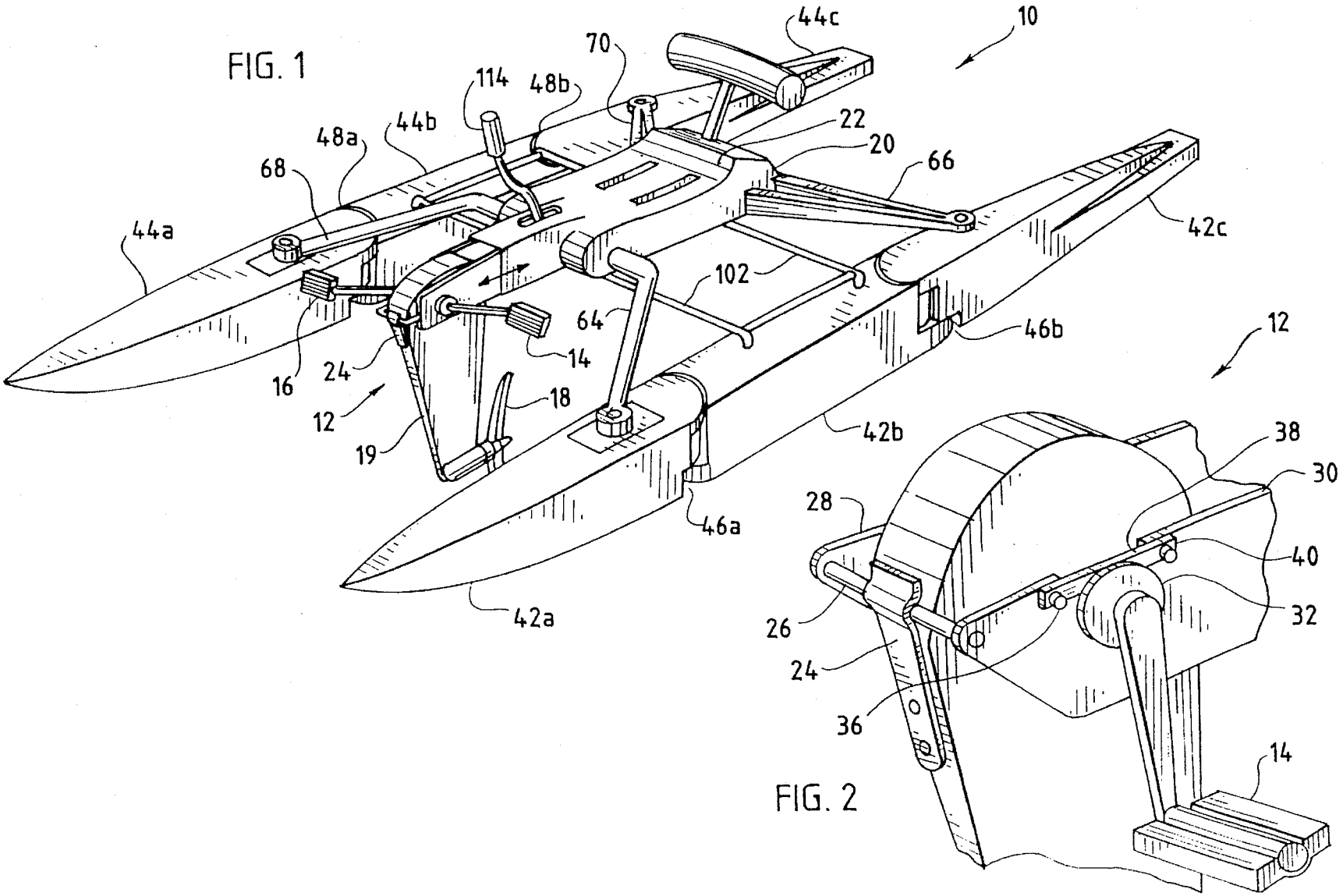
FIG. 1 is a perspective view of an aquatic vehicle according to the invention.
FIG. 2 is a perspective view of a portion of the propulsion unit of the aquatic vehicle of FIG. 1.

The preferred embodiment of a human powered aquatic vehicle or water bike 10 is depicted in FIG. 1 and includes a propulsion or drive unit 12 with a pair of pedals 14 and 16 rotatably mounted on its upper end and a propeller 18 rotatably mounted at the lower portion. The propeller 18 and the foot pedals 14 and 16 can be connected by a transmission (not shown) within a housing 19 that can include gears and a shaft, or a sprockets connected by a chain or a belt connecting pulleys. All have been found effective for this purpose.

The drive unit 12, as shown in FIGS. 1 and 2, is tiltably mounted to a support frame 20 which includes a seat 22. A spring clip 24 secured to a rod 26 holds the drive unit 12 in a vertical position. A pair of support brackets 28 and 30 projecting forward from the support frame 20 serve to hold the drive unit 12 in place as illustrated in FIG. 2. To provide for easy disassembly of the vehicle 10, the support brackets 28 and 30 each are configured with semi-circular cutouts 32 for holding a bearing or axle 34 connecting the pedals 14 and 16. The drive unit 12 can be removed from the brackets 28 and 30 by simply releasing a spring loaded pin 36, alternatively a screw can be used for the same purpose; rotating a retaining bar 38 upwardly around a pin 40; and lifting the unit 12 off of the brackets 28 and 30. The force of the propeller 18 will also aid in maintaining the drive unit 12 in the vertical direction. If the drive unit 10 should strike a submerged object, whether a log, a sandbar or a beachhead, the clip 24 will allow the drive unit 12 to tilt back to avoid damaging the drive unit 12 or propeller 18.

The vehicle 10 also includes a pair of articulated pontoons 42*a–c* and 44*a–c* each of which includes a forward section 42*a* or 44*a*, a center section 42*b* or 44*b* and an aft section 42*c* or 44*c*. The pontoon sections 42*a–c* and 44*a–c* are formed in such a manner as to include detachable hinges 46*a–b* and 48*a–b* at their joining ends.

Figure 3:
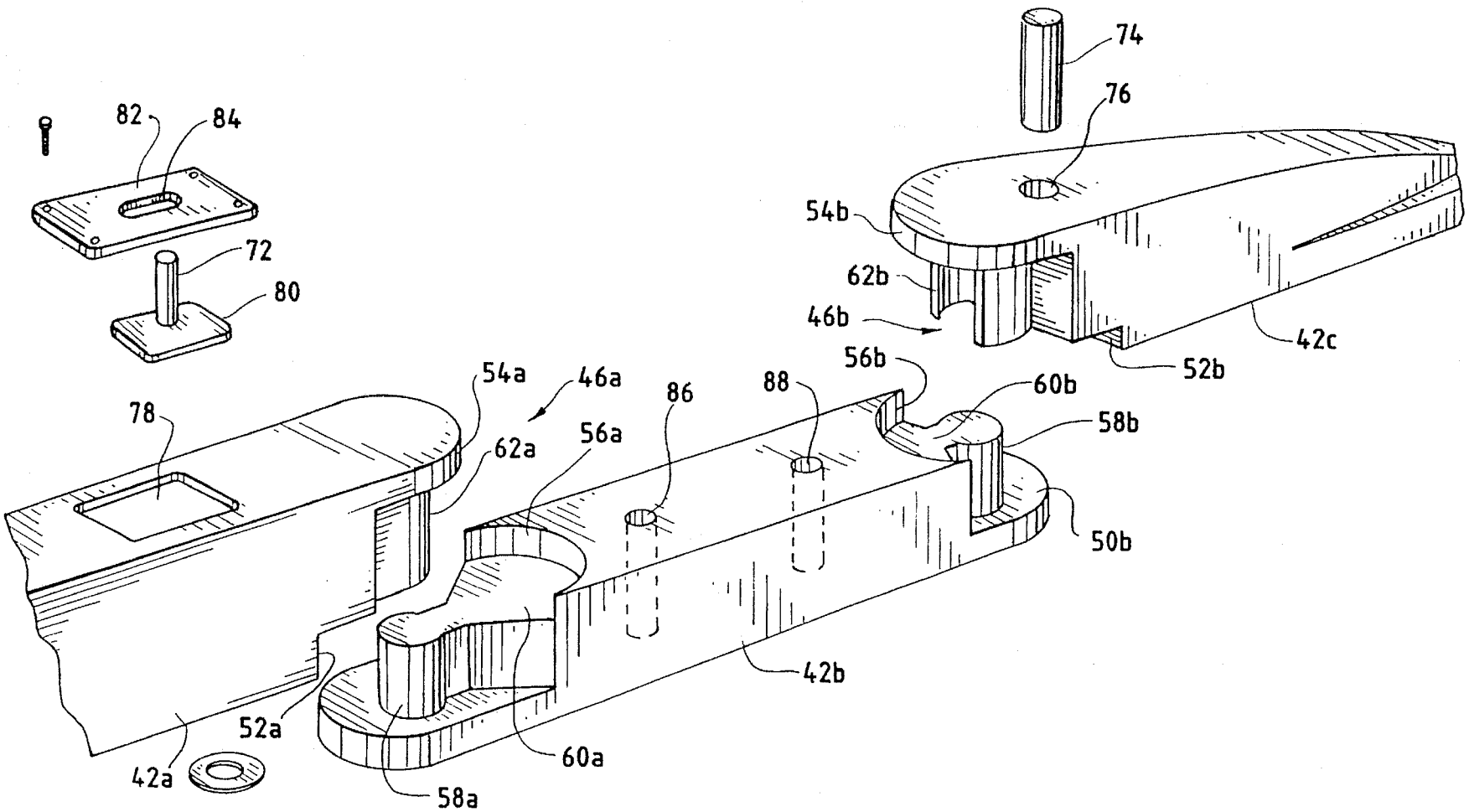
FIG. 3 is an exploded view of the pontoon hinge mechanism of the aquatic vehicle of FIG. 1.

As shown in the detailed drawing of the right pontoon 42*a–c* in FIG. 3, the hinges 46*a* and 46*b* includes a lower flange portion 50*a* and 50*b* configured in each end of the center pontoon section 42*b* which rotatably fit in a lower circular recess 52*a* and 52*b* configured respectively in the forward pontoon section 42*a* and the aft pontoon section 42*c*. Similarly, the forward and aft pontoon sections 42*a* and 42*c* have upper flange portions 54*a* and 54*b* that are received within a pair of corresponding circular recesses 56*a* and 56*b* configured in the ends of the center pontoon section 42*b*. Each end of the center pontoon section 42*b* also includes a hinge pin 58*a* or 58*b* coaxially secured to the lower flanges 50*a* and 50*b* and a y-shaped support 60*a* or 60*b*. When the forward and aft pontoon sections 42*a* and 42*c* are connected to the center pontoon section 42*b*, the hinge pins 58*a* and 58*b* will be received in a pair of hinge sockets 62*a* and 62*b* located on the upper flanges 54*a* and 54*b* of the forward and aft pontoon sections 42*a* and 42*c*. One of the more significant advantages of the invention is that the buoyancy of the center pontoon section 42*b* will operate to keep the center pontoon section 42*b* engaged with the forward and aft pontoon sections 42*a* and 42*c* so that it is not necessary to use fasteners to attach the pontoon sections 42*a–c* and 44*a–c* together. This feature also lends itself to easy transportation of the vehicle 10 because the pontoon sections 42*a–c* and 44*a–c* can be disassembled by simply lifting the forward and aft sections 42*a* and *c* and 44*a* and *c* from the center pontoon sections 42*b* and 44*b*.

Referring to FIGS. 1 and 3, the support frame 20 is attached to the forward and aft pontoon sections 42*a*, 42*c*, 44*a* and 44*c* by a set of support arms 64–70. More particularly, the support arms 64–70 are rotatably attached to a set of king pins two of which 72 and 74 are shown in detail in FIG. 3. The king pin 74 is inserted into a hole 76 in the aft pontoon section 42*c*. The forward pontoon section 42*a* has a recessed pad 78 on its upper surface that accepts a bearing plate 80 which includes the king pin 72. The bearing plate 78 and king pin 72 are secured to the forward pontoon section by a retainer plate 82 which includes a slot 84 that permits the bearing plate 78 and the king pin 72 to move fore and aft.

Figure 4:
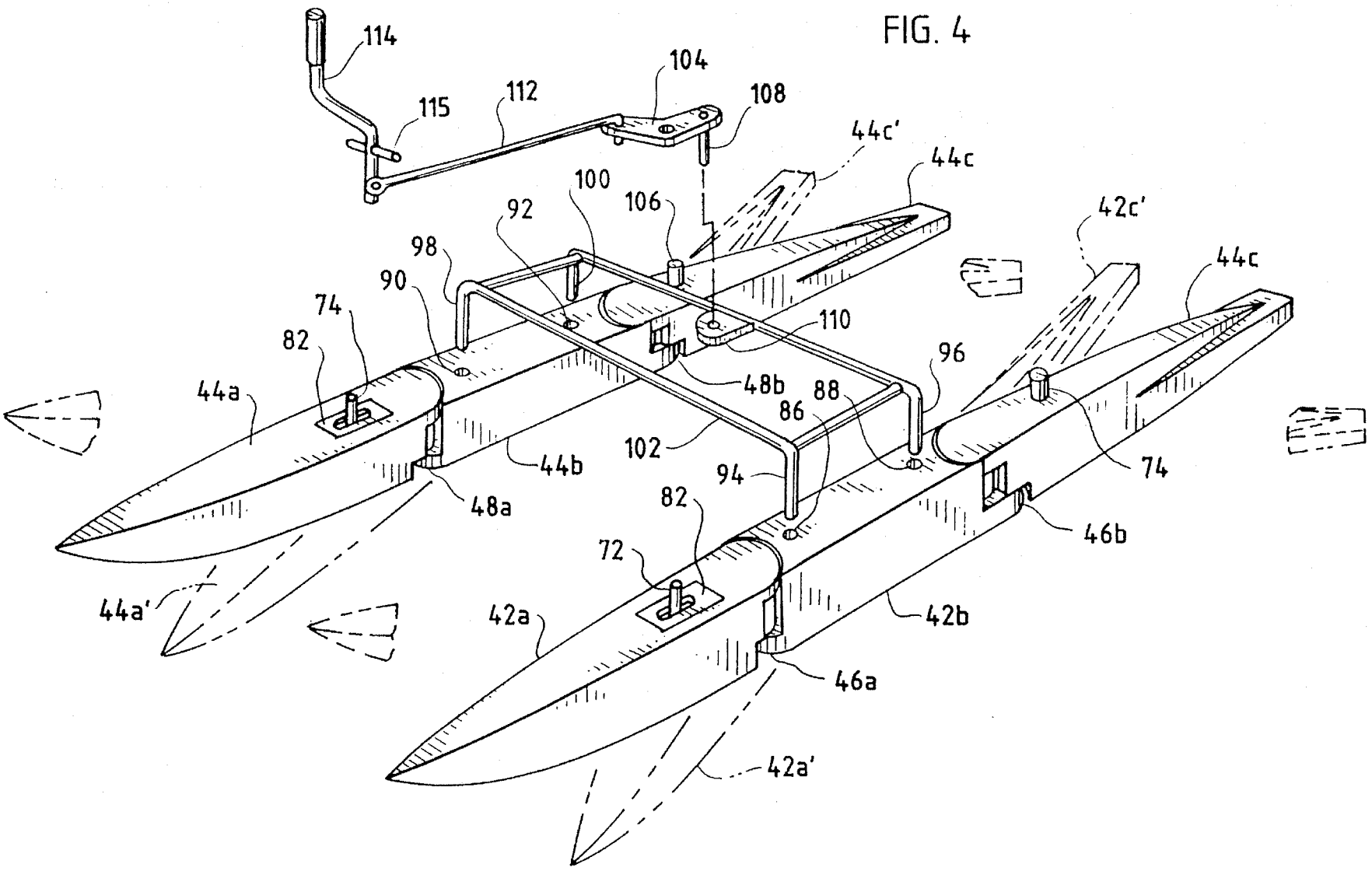
FIG. 4 is an exploded view of the steering mechansim of the aquatic vehicle of FIG. 1.

FIG. 4 is an exploded view illustrating the vehicle 10 steering mechanism. Center pontoon sections 42*b* and 44*b* each have a pair of holes 86 and 88 that will accept an arm 94–100 of a central frame member 102. The central frame member 102 transfers lateral movement to the central pontoon sections 42*b* and 44*b* as well as providing stability for the vehicle 10. A bell crank 104 is pivotably mounted by a pin 106, secured to the lower portion of the support frame 20 shown in FIG. 1, and includes a pin 108 that is engaged with the central frame 102 by a bracket 110. The bell crank 104 is actuated by steering rod 112 and a steering lever 114 which is also affixed by a pin 115 to the support structure 20.

When the frame structure 20 including the seat 22 is mounted to the assembled pontoon sections 42*a–c* and 44*a–c* by engaging the king pins 72 and 74, the center pontoon sections 42*b* and 44*b* can be moved transversely from side to side relative to the frame structure 20 by moving the steering lever 114 in the fore or aft direction. This results in the horizontal rotation of the forward and aft pontoon sections 42*a* and 44*a*, as illustrated by the dashed lines 42*a*', 42*c*', 44*a*' and 44*c*' in FIG. 4. In this manner the direction of the aquatic vehicle 10 can be controlled. Also, it should be noted that because pins 72 and 74 are located fore and aft of the hinges 46*a–b* and 48*a–b*, the centerline distance between pins 72 and 74 will shorten when the forward and aft pontoon sections 42*a*, 42*c*, 44*a* and 44*c* are rotated with respect to the center pontoon sections 42*b* and 44*b*. The elongated slot 84 in retainer plate 82 will allow pin 72 to slide thereby compensating for the reduction in distance between the pins 72 and 74.

I claim:

1. An aquatic vehicle comprising:

a support frame;

a pair of spaced apart articulated pontoons wherein each of said pontoons includes a center section along with a forward and an aft sections each of which are rotatably connected to said center section and rotatably connected to said support frame;

steering means, operatively connected to said pontoons, for rotating said forward and aft sections with respect to said center sections by moving said center sections; and propulsion means for propelling the vehicle in a forward direction.

2. The vehicle of claim 1 wherein said steering means includes a central frame member secured to each of said center sections, a plurality of support arms connected to said support frame wherein one of said support arms is pivotably connected to each of said forward and aft pontoon sections and translation means for laterally translating said central frame member with respect to said support frame.

3. The vehicle of claim 2 wherein said translation means includes a steering rod and a crank member rotatably connected to said support frame and having one end connected to said central frame member and the other end connected to a first end of said steering rod.

4. The vehicle of claim 3 wherein said translation means further includes a steering lever pivotably connected to said support frame and connected to a second end of said steering rod.

5. The vehicle of claim 2 additionally including a seat secured to said support frame.

6. The vehicle of claim 5 wherein said propulsion means, which includes a pair of pedals operatively connected to a propeller, is secured to said support frame forward of said seat.

7. The vehicle of claim 6 wherein said propulsion means includes a vertically orientated housing with said propeller mounted in the lower portion of said housing, transmission means located within said housing for transmitting rotational motion of said pedals to said propeller and tilt means for permitting lower portion of said housing to rotate upwardly in the aft direction in response to striking an object while the vehicle is traveling in the forward direction.

8. The vehicle of claim 2 wherein two of said support arms are connected to either of said forward or aft pontoon sections by a pivot mechanism that permits limited fore and aft travel of said support arms along its associated pontoon section.

9. The vehicle of claim 8 wherein said pivot mechanism includes a bearing plate slidable secured to its associated pontoon section, a retainer plate having an elongated slot and a king pin attached to said bearing plate, interposed through said slot and engaged with said support arm.

10. The vehicle of claim 1 wherein each of said center pontoon sections is connected to its associated forward and aft section by a detachable hinge.

11. The vehicle of claim 10 wherein said detachable hinge incudes a pin and socket arrangement wherein each of said center pontoon sections can be slidably engaged with its associated forward and aft sections and which permits at least a limited horizontal rotation of said forward and aft pontoon sections with respect to said center pontoon sections.

12. The vehicle of claim 11 wherein said detachable hinge includes a lower circular flange configured in the bottom surface of each end of said center pontoon section, a lower circular recess configured in the associated end of said forward and aft pontoon sections for receiving said lower flanges and an upper circular flange configured in the upper surface of the associated ends of said forward and aft pontoon sections and an upper circular recess configured in each end of said center pontoon sections for receiving said upper circular flanges.

13. The vehicle of claim 10 wherein said detachable hinge includes a lower circular flange configured in the bottom surface of each end of said center pontoon section, a hinge pin secured coaxially to said lower flanges, an upper circular flange configured in the top surface of one end of said forward and aft pontoon sections and a socket for receiving said hinge pins secured coaxially to said upper cicular flanges.

14. The vehicle of claim 11 wherein said pin and socket arrangement includes a hinge pin secured to one of said pontoon sections and a socket for slidable receiving said pin in its associated pontoon section.

15. The vehicle of claim 10 said detachable hinge is effectively maintained in engagement by the buoyancy of said center pontoon section.

16. The vehicle of claim 15 wherein said detachable hinge includes a flange configured in the upper surface of said forward and aft pontoon sections abutting a recessed portion of each end of said center pontoon section.

* * * * *